US006128840A

United States Patent [19]

Boisvert

[11] Patent Number: 6,128,840

[45] Date of Patent: Oct. 10, 2000

[54] DISPLAY CARD

[75] Inventor: Pierre Boisvert, Montreal, Canada

[73] Assignee: Pierre U. Boisvert, Montreal, Canada

[21] Appl. No.: 09/236,633

[22] Filed: Jan. 26, 1999

Related U.S. Application Data

[60] Provisional application No. 60/072,131, Jan. 22, 1998.

[51] Int. Cl.[7] ..... G09F 1/00

[52] U.S. Cl. ..... 40/124.191; 40/323; 206/8

[58] Field of Search ..... 40/124.01, 124.06, 40/124.191, 27.5, 323; 206/0.8, 0.82, 0.83, 0.84, 486, 488; D11/95; 156/303.1; 428/67, 355 N

[56] References Cited

U.S. PATENT DOCUMENTS

| | | | |
|---|---|---|---|
| 3,139,977 | 7/1964 | Burdick | 206/0.83 |
| 3,178,014 | 4/1965 | Goldwasser | 206/0.83 |
| 3,241,659 | 3/1966 | Segel | 206/0.82 |
| 3,371,851 | 3/1968 | Silene et al. . | |
| 3,957,157 | 5/1976 | Therrien | 40/323 X |
| 3,986,913 | 10/1976 | Walz | 156/303.1 X |
| 4,043,477 | 8/1977 | Deese | 206/0.83 X |
| 4,165,573 | 8/1979 | Richards | 206/0.8 X |
| 4,402,399 | 9/1983 | Friess | 206/0.83 |
| 4,425,997 | 1/1984 | Grant | 206/0.84 |
| 4,592,465 | 6/1986 | Stein | 206/0.83 |
| 4,694,093 | 9/1987 | Sugimori et al. . | |
| 4,771,106 | 9/1988 | Ohmae et al. . | |
| 4,776,797 | 10/1988 | Hernandez | 40/323 X |
| 5,015,718 | 5/1991 | Dorsey . | |
| 5,109,977 | 5/1992 | Mayer et al. | 206/0.8 |
| 5,150,792 | 9/1992 | Munroe | 206/486 |
| 5,656,701 | 8/1997 | Miyamoto et al. . | |

*Primary Examiner*—Joanne Silbermann

[57] ABSTRACT

A display card for displaying valuable collectible items such as coins, medals, fluids or the like that includes a card body having a display aperture extending therethrough. The card body has a core layer sandwiched between first and second card protective layers. A one sided self adhesive tape is adhesively bound to a surface of the card so as to extend across the display aperture. The display object is positioned within the display aperture so as to define a peripheral clearance relative to the latter. The display object is bound to the one sided self adhesive tape extending across the display aperture. A ring of adhesive material further binds the display object of the card by extending between the object peripheral edge and the peripheral edge of the display aperture.

20 Claims, 3 Drawing Sheets

10
12
14
16
18
20
22
24
26
28
30
32
34
36
38
40
42
44
46
48
2

DISPLAY CARD

This application claims the benefit of Provisional Application No. 60/072,131, filed on Jan. 22, 1998.

FIELD OF THE INVENTION

The present invention relates to the field of display packaging and is particularly concerned with a display card.

BACKGROUND OF THE INVENTION

One common method of advertising a product, service, location, event or the like consists in using so called business or advertising cards. Such cards typically have a relatively standard format and are easily stored in wallets or conventional card holders. One of the main drawbacks associated with prior art business cards or advertising cards is that they are rather plain looking and dull. Accordingly, there exists a need for an improved advertising card that would create a visually stimulating and aesthetically pleasing effect.

Also, relatively recent trend towards an increase amount of leisure time has concomitantly resulted in an increase in the number of individuals collecting items as a hobby. Accordingly, there also exist a need for an improved medium allowing collectors to exchange, display and protect valuable items.

The prior art is replete with various types of card like items that could be used both for advertising and displaying valuable collectibles. One example of such prior art structure is disclosed in U.S. Pat. No. 4,466,534 naming J. Malcolm Dunn as inventor and issued Aug. 21, 1984.

The hereinabove mentioned patent discloses a display package for small objects that uses a double sided adhesive insert between a pair of cover members. Each of the cover members is bound to a respectively associated adhesive side of the insert. The article to be displayed is sandwiched between window elements and in some form cushion and background elements that are themselves bound to associated adhesive sides of the insert.

While providing an interesting support for valuable objects, most of the prior art devices suffer from a set of drawbacks including the inability to ensure that the valuable objects will not be inadvertently removed from the supporting card or other substrate. Also, most prior art components do not allow proper protection of the valuable object against tarnishing, denting, stretching or otherwise damaging the latter. Furthermore, most prior art structures reduce the overall aesthetical appeal of the object mounted thereon. Still further, most prior art structures are relatively expensive to manufacture.

Accordingly, there exists a need for an improved display and advertising card.

Advantages of the present invention include the fact that the proposed display card allows for improved bounding of the displayed object to the display card so as to prevent the displayed object from being unawarely separated from the display card. Also, the present invention proposes a display card that provides improved protection to the displayed object against damaged caused by tarnishing, denting, scratching or the like.

Also, the proposed display card provides an item that remains relatively flexible even when the displayed object is mounted thereon thus enhancing its overall commercial appeal. Still further, the displayed object mounted on the display card is mounted so as to be visually accessible from both sides of the display card. Also, the display card is specifically designed so as to accommodate a large variety of display objects.

Still further, the proposed display card has built in features adapted to improve its longevity and reduce the risk of having the card damaged by repeated bending action.

The present invention also relates to an improved method of manufacturing a display card so as to provide a card offering the previously mentioned advantages while maintaining manufacturing cost at a relatively low level.

In accordance with one aspect of the invention, there is provided a display card comprising a generally flat card body, the card body defining a card first display surface, an opposed card second display surface and a card peripheral edge; the card body having a display aperture extending therethrough, the display aperture defining an aperture peripheral edge; a display positioned within the display aperture, the display object defining an object first display surface, a generally opposed object second display surface and an object peripheral edge; the display aperture being configured and sized so as to define a peripheral clearance between the aperture peripheral edge and the object peripheral edge; a first securing means for securing the display object within the display aperture, the first securing means extending and being attached to the aperture peripheral edge and the object peripheral edge; a second securing means for securing the display object within the display aperture, the second securing means being attached to both the card first display surface and the object first display surface.

Preferably, the first securing means includes a ring of adhesive material filling the peripheral clearance and adhesively binding to both the aperture peripheral edge and the object peripheral edge. Also, conveniently, the ring is made out of a material presenting flexible and resilient structural characteristics so as to allow for a relative movement between the aperture peripheral edge and the object peripheral edge. Furthermore, the ring of adhesive material is made out of a polyurethane resin.

Conveniently, the second securing means includes a one sided self adhesive layer of polymeric material adhesively binding to both the card first display surface and the object first display surface. The one sided self adhesive layer of polymeric material preferably offers relative resilient and flexible structural characteristics so as to allow for a relative movement between the aperture peripheral edge and the object peripheral edge. Typically, the one sided self adhesive layer of polymer material is made out of polyester.

The display card preferably further includes an object first protective layer bound to the object first display surface. Typically, the object first protective layer is made out of a generally transparent and wear resistant material.

Conveniently, the display card also includes an object second protective layer bound to the object second display surface. Preferably, the object second protective layer is made out of an epoxy resin.

Conveniently, the card body is of a composite nature including a card core sandwiched between a card first protective layer and a card second protective layer. Preferably, the card core is made out of paperlike polymeric resin. Conveniently, the card first and second protective layers are made out of polyester polyamide.

In one embodiment, the display object is made out of a relatively rigid material. In another embodiment, the display object includes a container filled with a relatively fluid material.

In accordance with another aspect of the invention, there is proposed a method of manufacturing a display card comprising the steps of forming a display aperture through a card body, the card body defining a card first display surface and an opposed card second display surface, the aperture defining an aperture peripheral edge; binding a one sided self adhesive layer of material to the card first display surface so as to extend across the display aperture, mounting a display object having an object peripheral edge within the display aperture so that a peripheral spacing is created within the object peripheral edge and the aperture peripheral edge and binding the display object to the one sided self adhesive layer of polymeric material; filling the peripheral spacing with a ring of adhesive material so that the ring of adhesive material binds to both the object peripheral edge and the aperture peripheral edge.

Conveniently, the method further comprises the steps of binding an object protective layer to the object first display surface; marking an indicia on at least one of the card display surfaces and forming the card body by laminating together a core central layer between a card first protective layer and a card second protective layer.

BRIEF DESCRIPTION OF THE DRAWINGS

Various embodiments of the present invention will now be described, by way of example, in reference to the following drawings in which.

DETAILED DESCRIPTION

Figures 1, 2, 3, 4:
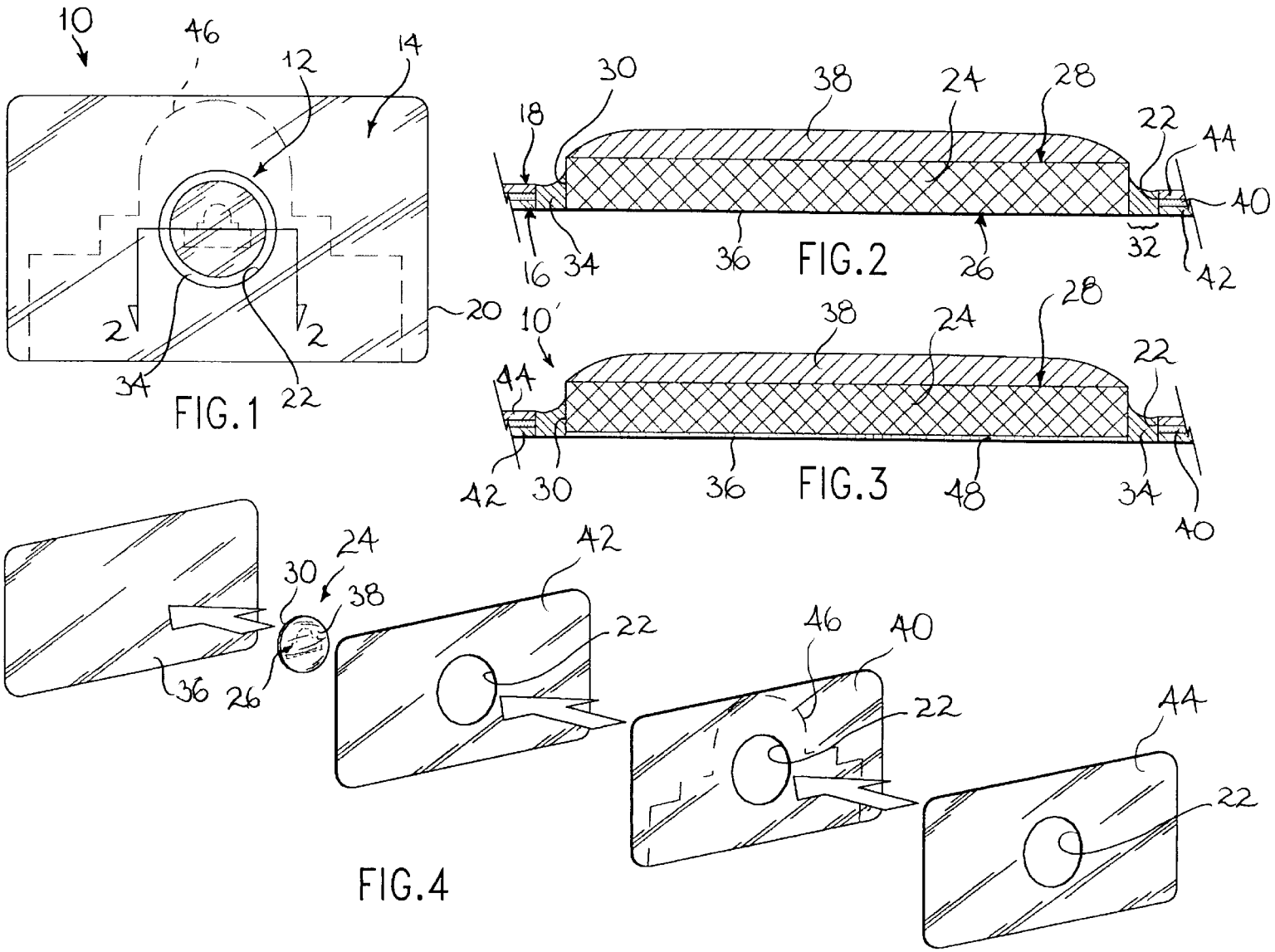
FIG. 1, in an elevational view, illustrates a display card in accordance with the first embodiment of the present invention.
FIG. 2, in a partial cross sectional view with sections taken out, taken along arrows 2—2 of FIG. 1, illustrates part of the display card shown in FIG. 1.
FIG. 3, in a partial cross sectional view with sections taken out, illustrates part of the display card in accordance with a second embodiment of the present invention.
FIG. 4, in an exploded view, illustrates various components part of the display card shown in FIG. 1.

Referring to FIG. 1, there is shown a display card 10 in accordance with a first embodiment of the present invention. The display card 10 has a generally flat configuration defining a generally rectangular peripheral edge. It should be understood however that the display cards shown in FIGS. 1 through 11 could present various peripheral configurations such as that of a triangle, a disc or any other suitable configuration without departing from the scope of the present invention.

The display card 10 defines a generally centrally disposed display area 12 surrounded by a display frame 14. Again, it should be understood that although the display area 12 of the cards shown in FIGS. 1 through 11 are generally centrally disposed, the display area 12 could be positioned at other location's part of the display card 10 without departing from the scope of the present invention.

The display card 10 has a generally flat card body. The card body defines a card first display surface 16, an opposed card second display surface 18 and a card peripheral edge 20.

The card body has a display aperture 22 extending therethrough. The display aperture 22 defines a corresponding aperture peripheral edge.

A display object 24 is positioned within the display aperture 22. The display object 24 defines an object first display surface 26, a generally opposed object second display surface 28 and an object peripheral edge 30.

The display aperture 22 is configured and sized so as to define a peripheral clearance 32 between the aperture peripheral edge and the object peripheral edge 30.

The card 10 also includes a first securing means for securing the display object 24 within the display aperture 22. The first securing means extends between and is attached to both the aperture peripheral edge and the object peripheral edge 30. Preferably the first securing means takes the form of a ring 34 of adhesive material filling the peripheral clearance 22 and adhesively bounding the aperture peripheral edge to the object peripheral edge 30. The adhesive material used for the first securing means preferably also has inherent flexible and resilient characteristics so as to allow for predetermined amount of relative movement between the aperture peripheral edge and the object peripheral edge 30.

Typically, although by means exclusively, the adhesive material is a polymeric resin part of the polyurethane family of polymers. Polyurethane offers good adhesive characteristics while being both transparent and relatively flexible. Also, polyurethane residues typically withstand low grade ultraviolet radiation without being substantially altered.

The card 10 further includes a second securing means for securing the display object 24 within the display aperture 22. The second securing means is bound to the card first display surface 16 and the object first display sugrface 26. Consequently, the second securing means preferably extends from the card first display surface 16, across the peripheral clearance 32 and unto the object first display surface 26. The second securing means preferably takes the form of a one sided self adhesive layer 36 of adhesive material that adhesively binds to the card first display surface 16 and the object first display surface 26.

Preferably, the layer 26 also offers flexible and resilient characteristics so as to allow relative movement between the object peripheral edge 30 and the aperture peripheral edge 22. Furthermore, the layer 36 also preferably binds to a first display surface of the ring 34. Typically, the layer 36 is made out of a polymeric material having a thickness substantially in the range of 2 mils. The card 10 further includes an object second protective layer 38 bound to the object second display surface 28. The object second protective layer 38 is preferably adhesively bound to the object second surface 28.

The object second protective layer 38 is adapted to protect the object second display surface 28 against scratching, nicking, tarnishing or otherwise damaging the latter.

Preferably, the object second protective layer 38 is made out of a suitable polymeric resin such as a layer of epoxy resin. Epoxy offers inherent transparent and wears resistance characteristics. Furthermore, epoxy resin typically hardens with relatively low ultraviolet radiation. Typically, the objects second protective layer defines a generally dome shaped cross sectional configuration.

Another main feature of the present invention resides in that the card body has a specifically designed composite structure adapted to provide interesting structural characteristics. The card body preferably includes a central core layer 40 sandwiched between a card first protective layer 42 and a card second protective layer 44.

The core layer 40 is preferably made out of a polymeric resin offering relatively good binding characteristic while facilitating marking of inscriptions thereon. Typically the core layer 40 is formed out of a paperlike resin having a thickness substantially in the range of 8 mils. Paperlike polymeric resin further offers the advantage of being relatively resistant to both heat and ultraviolet radiation. The central core layer 40 is preferably provided with inscriptions 46 printed on otherwise marked thereon.

The card first and second protective layers 42, 44 are preferably made out of a suitable polymeric resin allowing for a predetermined amount of flexibility and wear resistance characteristics. Typically, the card first and second protective layers 42, 44 are made out of polyester polyamide resin having a thickness substantially in range of 10 mils. Polyester polyamide resins further provide the advantage of blending relatively well with paperlike polymeric resins and being relatively resistant to both heat and ultraviolet radiation.

Referring now more specifically to FIG. 3, there is shown a second embodiment of the invention 10'. The card 10' is substantially similar to the hereinabove described card 10 and, thus, similar reference numerals will be used to denote similar components. One of the main differences between the card 10 and 10' resides in the presence of an object first protective layer 48. The object first protective layer 48 is bound to the object first display surface 26 so as to become relatively integral therewith. The object first protective layer 48 is preferably made out of a transparent and relatively resisting material. The object first protective layer 48 is adapted to protect the object first display surface 26 and to act as a shim for the display object 24.

Referring now more specifically to FIGS. 6 through 11, there is shown respectively a third, fourth and fifth embodiments of the present invention 10", 10'" and 10"". The embodiment 10" is substantially identical to the embodiment 10 and thus similar reference numerals will be used to denote similar components.

One of the main differences between the embodiment 10" and the embodiment 10 resides in the nature of the display object 24. The display object part of the embodiment 10 preferably has a generally solid inherent structural characteristic. For example, the display object 24 of the embodiment 10 may take the form of a coin, a gemstone, a medal or any other relatively valuable objects. The embodiment 10" is more specifically adapted to include display objects comprising containers filled with relatively fluid materials such as liquids or granular materials.

Figures 5, 6, 7, 8:
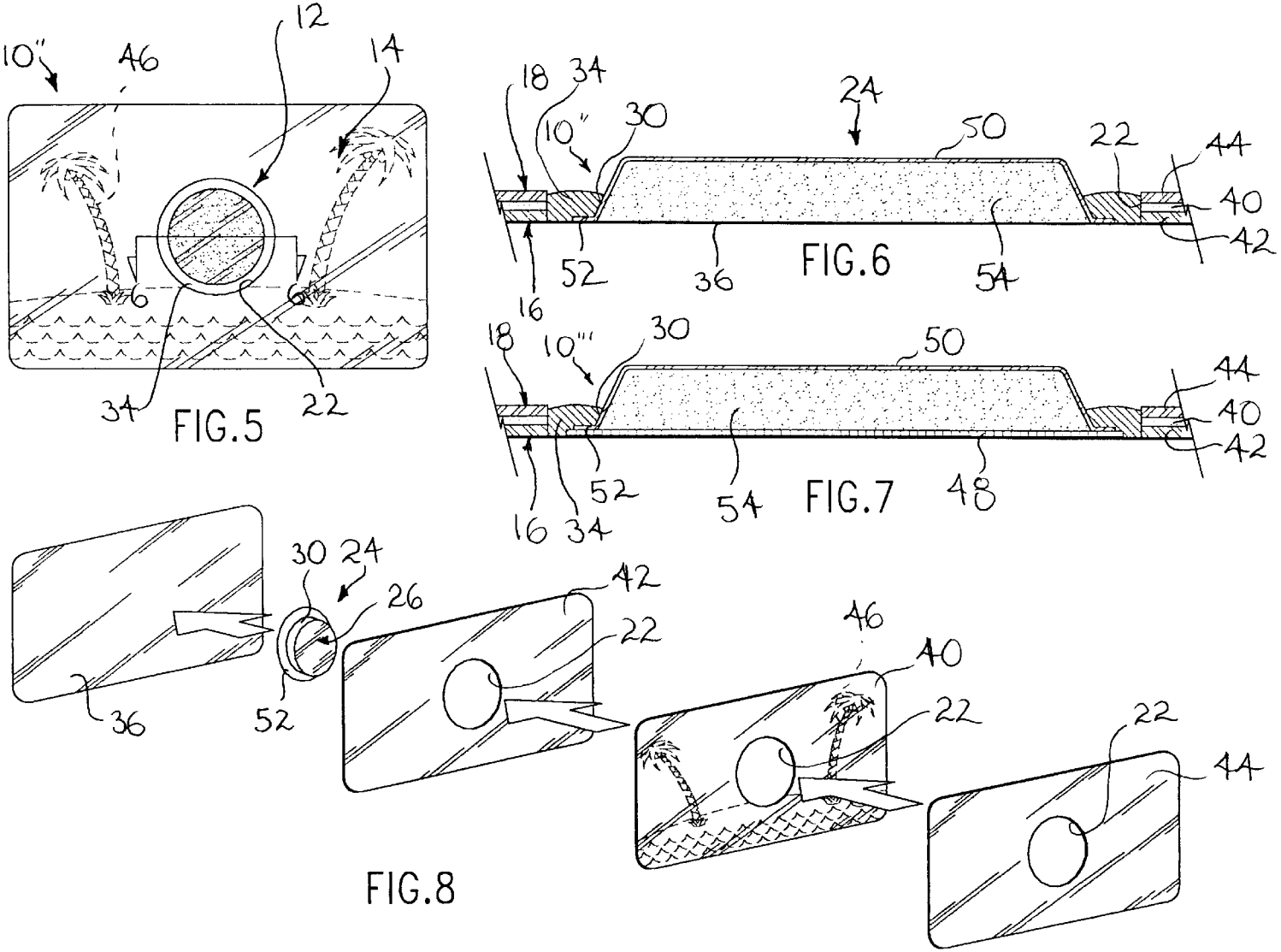
FIG. 5, in an elevational view, illustrates a display card in accordance with a third embodiment of the present invention.
FIG. 6, in a partial cross sectional view taken along arrows 6—6 of FIG. 5, illustrates part of the display card shown in FIG. 5.
FIG. 7, in a partial cross sectional view with sections taken out, illustrates a display card in accordance with a fourth embodiment of the present invention.
FIG. 8, in an exploded view, illustrates some of the components part of the display card shown in FIG. 6.

For example, the display object 24 shown in FIG. 6 is a conventional blister pack filled with materials such as oils, holy water, blood, other types of fluids or granular material such as sand or the like. As is well known in the art, the blister pack typically includes a generally dome shaped window 50 having a peripheral lip 52 and made out of a suitable polymeric resin. The blister pack is shown filled with a filling liquid 54. The lower surface of the filling liquid 54 defines the object first display surface 26.

FIG. 7, illustrates the embodiment 10'". The embodiment '" is substantially identical to the embodiment 10" except for the presence of an object first protective layer 48 similar to that shown in FIG. 3.

Figure 10:
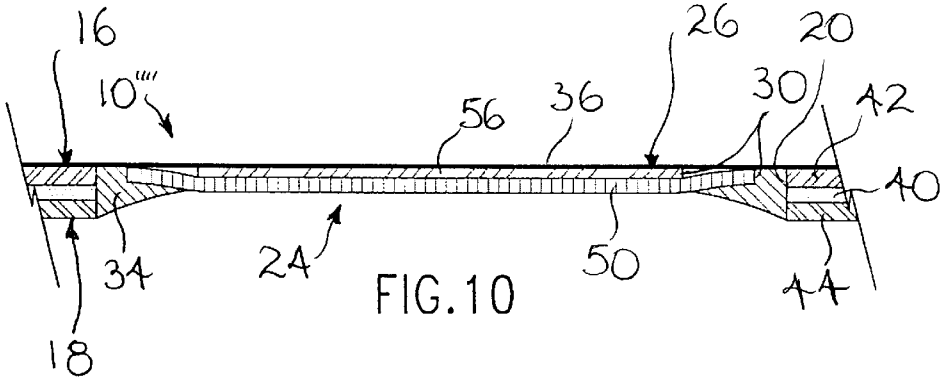
FIG. 10, in a partial cross sectional view with sections taken out, illustrates part of the display card shown in FIG. 9.
Figure 9:
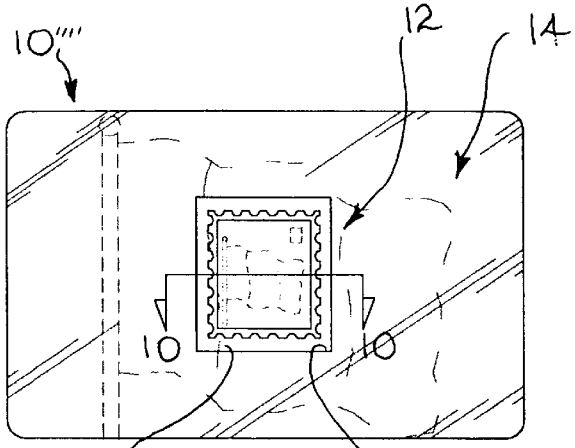
FIG. 9, in an elevational view with sections taken out, illustrate a display card in accordance with a fifth of the present invention.
Figure 11:
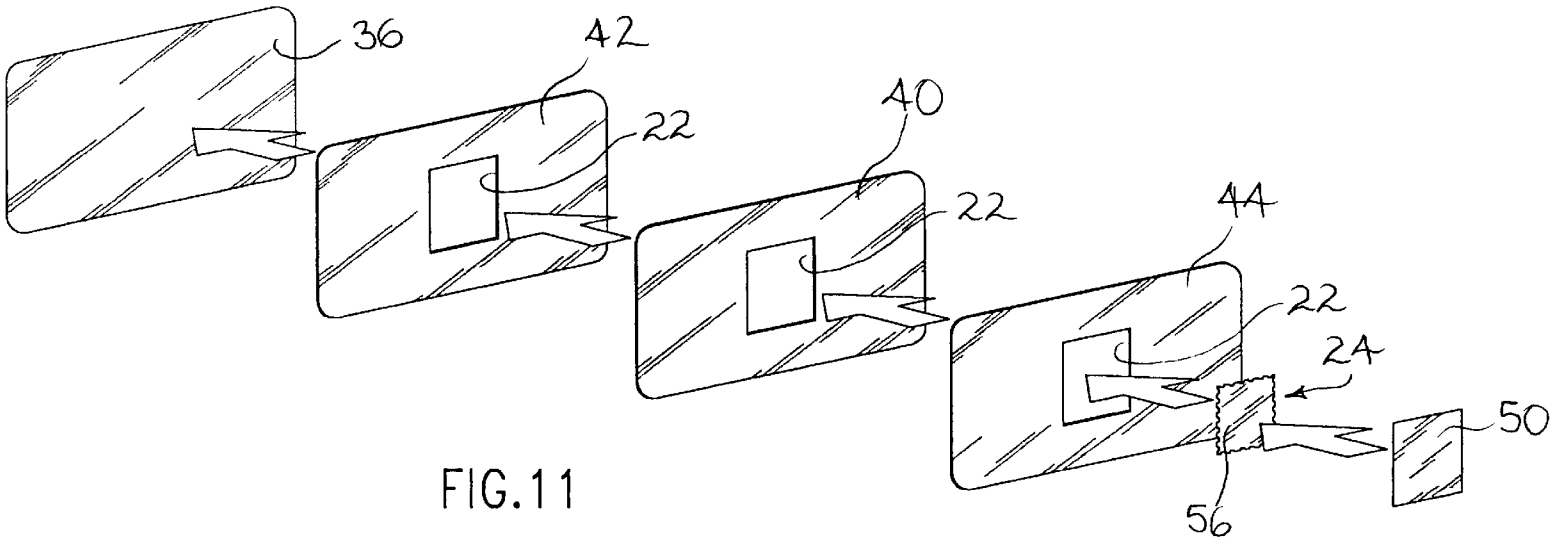
FIG. 11, in an exploded view, illustrates some of the component's part of the display card shown in FIG. 9.

FIGS. 9 through 11, illustrate a display card 10"" in accordance with yet a fifth embodiment of the present invention. The display card 10"" is substantially identical to the display card 10" and, hence, similar reference numerals will be used to denote similar components. One of the main differences between the display card 10"" display card 10" resides in that the displayed object 24 of the display card 10"" includes a relatively thin and flexible object 56 such as a stamp, envelope or the like protected by a blister pack type window 50. The flexible object 56 is thus used instead of the relatively fluid material 54.

The present invention not only relates to a novel display card but also to a novel method of manufacturing the same. The novel method of manufacturing the display card includes at least some of the following steps: When a marking such a drawing, design, lettering or the like is to be inscribed on the core layer 40 it is first marked thereon by printing or other suitable means.

Either one or both sides of the core layer 40 may be provided with an indicia 46 marked thereon. The card first and second protective layers 42, 44 are then laminated together with the core layer 40 using suitable heat and pressure parameters. The display aperture 22 is then punched out or otherwise formed in the card body.

Once the display aperture is formed, the second securing means is bound to the card first display surface so as to extend across the display aperture. The second securing means is preferably bound to the card first display surface by a cold lamination process. The display object 24 is then mounted within the display aperture 22 and bound to the second securing means 36.

The peripheral spacing 32 is then filled with the ring 34 so that the latter contacts both the aperture peripheral edge and the object peripheral edge 30. The card is then dried using low heat and low intensity ultraviolet radiation. In situations wherein object first and/or second protective layers are used, the latter are secured to their respective object first and second display surfaces prior to insertion within the display aperture.

The embodiments of the invention in which an exclusive privilege or property is claimed are defined as follows:

1. A display card comprising a generally flat card body, said card body defining a card first display surface, an opposed card second display surface and a card peripheral edge;

said card body having a display aperture extending therethrough, said display aperture defining an aperture peripheral edge;

a display object positioned within said display aperture, said display object defining an object first display surface, a generally opposed object second display surface and an object peripheral edge;

said display aperture being configured and sized so as to define a peripheral clearance between said aperture peripheral edge and said object peripheral edge;

a first securing means for securing said display object within said display aperture, said first securing means extending and being attached to said aperture peripheral edge and said object peripheral edge;

a second securing means for securing said display object within said display aperture, said second securing means being attached to both said card first display surface and said object first display surface.

2. A display card as recited in claim 1 wherein said first securing means includes a ring of adhesive material filling said peripheral clearance and adhesively binding to both said aperture peripheral edge and said object peripheral edge.

3. A display card as recited in claim 2 wherein said ring is made out of a material presenting flexible and resilient structural characteristics so as to allow for a relative movement between said aperture peripheral edge and said object peripheral edge.

4. A display card as recited in claim 3 wherein said ring of adhesive material is made out of a polyurethane resin.

5. A display card as recited in claim 1 wherein second securing means includes a one sided self adhesive layer of polymeric material adhesively binding to both said card first display surface and said object first display surface.

6. A display card as recited in claim 5 wherein said one sided self adhesive layer of polymeric material offers relative resilient and flexible structural characteristics so as to allow for a relative movement between said aperture peripheral edge and said object peripheral edge.

7. A display card as recited in claim 6 wherein said one sided self adhesive layer of polymeric material is made out of polyester.

8. A display card as recited in claim 1 further comprising an object first protective layer bound to said object first display surface.

9. A display card as recited in claim 8 wherein said object first protective layer is made out of a generally transparent and wear resistant material.

10. A display card as recited in claim 1 further comprising an object second protective layer bound to said object second display surface.

11. A display card as recited in claim 10 wherein said object second protective layer is made out of an epoxy resin.

12. A display card as recited in claim 1 wherein said card body is of a composite nature including a card core sandwiched between a card first protective layer and a card second protective layer.

13. A display card as recited in claim 12 wherein said card core is made out of paperlike polymeric resin.

14. A display card recited in claim 12 wherein said card first and second protective layers are made out of polyester polyamide.

15. A display card as recited in claim 1 wherein said display object is made out of a relatively rigid material.

16. A display card as recited in claim 1 wherein said display object includes a container filled with a relatively fluid material.

17. A method of manufacturing a display card comprising the steps of:

forming a display aperture through a card body, said card body defining a card first display surface and an opposed card second display surface, said aperture defining an aperture peripheral edge;

binding a one sided self adhesive layer of material to said card first display surface so as to extend across said display aperture;

mounting a display object having an object peripheral edge within said display aperture so that a peripheral spacing is created within said object peripheral edge and said aperture peripheral edge and binding said display object to said one sided self adhesive layer of polymeric material;

filling said peripheral spacing with a ring of adhesive material so that said ring of adhesive material binds to both said object peripheral edge and said aperture peripheral edge.

18. A method as recited in claim 17 further comprising the step of binding an object protective layer to said object first display surface.

19. A method as recited in claim 16 further comprising the step of binding marking an indicia on at least one of said card display surfaces.

20. A method as recited in claim 17 further comprising the step of forming said card body by laminating together a core central layer between a card first protective layer and a card second protective layer.

* * * * *